United States Patent [19]

Norman et al.

[11] Patent Number: 4,649,945

[45] Date of Patent: Mar. 17, 1987

[54] ADJUSTABLE AIR DILUTION CIGARETTE EXHIBITING CONTROLLED PRESSURE DROP

[75] Inventors: Alan B. Norman, Clemmons; Glenn E. Creamer, Pfafftown, both of N.C.

[73] Assignee: R. J. Reynolds Tobacco Company, Winston-Salem, N.C.

[21] Appl. No.: 804,964

[22] Filed: Dec. 5, 1985

[51] Int. Cl.[4] ..... A24D 3/04; A24D 3/18

[52] U.S. Cl. ..... 131/336; 131/198.2; 131/338

[58] Field of Search ..... 131/198.1, 198.2, 336, 131/338-341, 361

[56] References Cited

U.S. PATENT DOCUMENTS

| | | | |
|---|---|---|---|
| 1,015,723 | 1/1912 | Blackwood | 131/198.2 |
| 2,304,009 | 11/1938 | Muth | 131/336 |
| 2,923,647 | 2/1960 | Aghnides | 131/336 |
| 3,289,678 | 12/1966 | Fassbender | 131/198.2 |
| 3,359,988 | 12/1967 | Thomson | 131/338 |
| 3,496,995 | 2/1970 | Tomkin | 131/336 |
| 3,503,406 | 3/1970 | Riegel et al. | 131/336 |
| 3,695,274 | 10/1972 | Summers . | |
| 3,774,622 | 11/1973 | Steigerwald . | |
| 4,343,319 | 8/1982 | Cantrell . | |
| 4,433,696 | 2/1984 | Adams . | |
| 4,446,878 | 5/1984 | Porenski, Jr. | 131/336 |
| 4,526,183 | 7/1985 | Nichols et al. . | |
| 4,527,573 | 7/1985 | Hausermann . | |
| 4,532,943 | 8/1985 | Nichols et al. . | |
| 4,559,955 | 12/1985 | Brockway et al. . | |
| 4,570,649 | 2/1986 | Nichols et al. . | |
| 4,601,298 | 7/1986 | Nichols et al. . | |

FOREIGN PATENT DOCUMENTS 107507 10/1983 European Pat. Off. .

OTHER PUBLICATIONS

The Design of Cigarettes by Colin L. Browne, see pp. 50 and 51, Second edition, copyright 1979, 1981 by Celanese Corp.

*Primary Examiner*—V. Millin
*Assistant Examiner*—H. Macey
*Attorney, Agent, or Firm*—Grover M. Myers

[57] ABSTRACT

A smoking article such as a filter cigarette can have an adjustable delivery air dilution while exhibiting a reduced pressure drop decrease during air dilution thereof. The pressure drop decrease is controlled during various stages of air dilution by positioning the structure for greatest air dilution on the cigarette a greater distance from the extreme mouthend of the cigarette relative to the structure for least air dilution. Filter cigarettes of this invention are capable of exhibiting a somewhat constant smoking character at various air dilution levels.

20 Claims, 8 Drawing Figures

ADJUSTABLE AIR DILUTION CIGARETTE EXHIBITING CONTROLLED PRESSURE DROP

BACKGROUND OF THE INVENTION

This invention relates to smoking articles, and in particular to adjustable air dilution smoking articles.

Popular smoking articles such as cigarettes comprise a substantially rod shaped structure and include a smokable material such as strands of tobacco surrounded by a wrapper such as paper. It has been desirable to provide cigarettes having filters constructed from fibrous materials such as cellulose acetate. Ventilation of the filter can be employed in order to provide an air diluted delivery.

Filtration of the smoke and ventilation of the cigarette filter can affect the flavor of the cigarette. In particular, as ventilation (or air dilution) is increased and the smoke to ventilation air ratio is decreased, the flavor of the cigarette is reduced. As the air dilution of most commercial cigarettes is fixed at the factory, a smoker of a particular air diluted cigarette is forced to change brands in order to obtain a cigarette having a different air dilution but similar taste.

Recently, adjustable delivery cigarettes haVe become objects of interest as is evidenced by U.S. Pat. Nos. 4,433,696; 4,527,573 and 4,526,183. The types of cigarettes as are disclosed in the aforementioned patents do not entirely provide the smoker with the most highly desirable smoking article. In particular, variable air dilution settings of such types of cigarettes provide variable pressure drops. Such variable pressure drops are highly undesirable in that a smoker is forced to change his/her smoking pattern in order to compensate for the variation in pressure drop and to resort to various ranges of effort when drawing on smoking articles having variable air dilution settings. Thus, the smoker does not have available a variable air dilution cigarette which exhibits a substantially constant smoking character throughout the range of variable air dilution settings.

As disclosed in U.S. Pat. No. 4,532,943; an adjustable delivery cigarette can have a filter plug comprising a first mouth-end segment of filter tow axially connected to a second rod-end segment of filter tow for rotation about the axis of the cigarette. In addition, it is disclosed that passages in the first and second segments can be in varying degrees of registry upon rotation of the aforementioned segments in order to vary the resistance to draw of the cigarette. Such an adjustable delivery cigarette having a variable resistance to draw would appear to provide a change in resistance to draw only upon essentially complete misalignment of the passages. Thus, it is expected that the cigarette would exhibit numerous air dilution settings while having essentially only two resistance to draw settings. In addition, it would appear that an adjustable delivery cigarette having a variable resistance to draw is difficult to manufacture as the passages would have to be formed, misaligned (i.e., into the high resistance to draw setting) when the high air dilution opening is provided, and realigned into the low air dilution setting (and low resistance to draw) for packaging.

Smoking articles exhibiting controlled pressure drop are disclosed in U.S. Pat. Nos. 3,774,622; 3,695,274; 4,343,319 and 4,380,241. However, such disclosed smoking articles are not variable air dilution smoking articles.

In view of the deficiencies of the prior art, it would be highly desirable to provide a smoking article such as a filter cigarette, having a means to provide variable air dilution settings, and being capable of exhibiting a controlled pressure drop throughout the range of air dilution settings.

SUMMARY OF THE INVENTION

This invention preferably is a smoking article capable of exhibiting a substantial reduction of pressure drop decrease during air dilution thereof. The smoking article is in the form of a filter cigarette including in combination a rod of smokable material, an axially aligned filter plug at one end of the rod, a substantially air impermeable tipping material circumscribing and being fixedly attached to each of the filter plug and a portion of the rod in the region adjacent the filter plug. The smoking article further comprises a substantially air impermeable sleeve circumscribing the cigarette and longitudinally extending along a portion of the length of the cigarette. The cigarette has at least two air dilution means positioned therein whereby the means for greatest air dilution is positioned a greater distance from the extreme mouthend of the cigarette relative to the means for least air dilution. The sleeve is movable relative to the cigarette whereby one of the air dilution means is exposed to permit air dilution of the smoking article, and the sleeve overlies the remaining air dilution means thereby providing a substantial barrier to air dilution therethrough.

Surprisingly, the present invention provides the user of an adjustable delivery air dilution smoking article with a useful, efficient and effective method for achieving the desirable advantages of an air dilution smoking article while consuming a smoking article capable of exhibiting a somewhat constant smoking character at various air dilution levels. The user of this invention can easily position the sleeve relative to the cigarette in order to expose various air dilution means and hence vary the air dilution capabilities of the smoking article. The frictional contact between the outer surface of the tipping material and the inner surface of the sleeve is sufficient to hold the assembly in place after adjustment by the user.

DETAILED DESCRIPTION OF THE EMBODIMENTS

Figure 1:
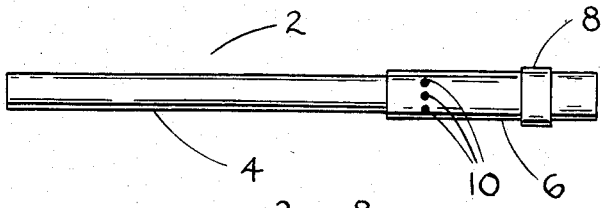
FIGS. 1 and 2 are diagrammatic illustrations of an embodiment of the smoking article in the form of a filter cigarette and the sleeve circumscribing the cigarette, wherein the sleeve is adjustable longitudinally along the cigarette to provide high air dilution setting and low air dilution setting, respectively.

The invention will be described with reference to FIGS. 1 through 8 in which like elements are given like reference numbers throughout.

An embodiment of this invention shown in FIGS. 1 through 8 is a smoking article 2 in the form of a filter cigarette. The filter cigarette comprises a generally cylindrical rod 4 of smokable material contained in a wrapping material. Typically, the smokable material is a charge of tobacco, reconstituted tobacco, tobacco substitute, or a blend thereof; and the wrapping material is a conventional cigarette wrapping paper. Rod 4 has a diameter comparable to that of conventional cigarettes and generally ranges from about 7 mm to about 8 mm. Rod 4 has a longitudinally extending length comparable to the tobacco rod length of a conventional cigarette and generally ranges from about 57 mm to about 85 mm. The cigarette further comprises a filter element 6 positioned adjacent to one end of rod 4 such that the filter element is axially aligned with and substantially abuts the rod in an end-to-end relation. Filter element 6 has a substantially cylindrical shape, and has a diameter essentially equal to that of rod 4. The ends of the filter plug are open to permit the passage of air and smoke. Filter element 6 can be constructed from any conventional filter material such as cellulose acetate tow which is preferably overwrapped with and fixedly secured to a circumscribing wrap material such as conventional paper plug wrap. Filter element 6 has a longitudinally extending length comparable to the filter element length of a conventional cigarette and generally ranges from about 19 mm to about 35 mm. Filter element 6 is attached to rod 4 by tipping material which circumscribes both the filter element and an adjacent region of the rod. The inner surface of the tipping material is fixedly secured to the outer surface of the filter element and to the wrapping material of an adjacent region of the rod. Typically, the tipping material is a conventional substantially air impermeable tipping material such as tipping paper. Sleeve 8 circumscribes the filter and is movable along the longitudinal axis and/or circumferentially about the longitudinal axis of the smoking article. Sleeve 8 is constructed from substantially air impermeable materials such as plastic or tipping paper. The inner diameter of the sleeve is greater than the outer diameter of the filter cigarette in order to allow movement of the sleeve relative to the filter cigarette. However, the inner diameter of the sleeve is sufficiently small in order that resistance provided by frictional contact between the inner surface of the sleeve and the outer surface of the filter cigarette can hold the sleeve in place once set by the user. In addition, retention means (not shown) can be used in order to limit the longitudinal movement of the sleeve along the length of filter cigarette, particularly in order to prevent the sleeve from being inadvertently removed from the cigarette.

The filter cigarette comprises air dilution means in regions longitudinally spaced along the length of the cigarette. Air dilution means can be in the form of an air permeable region such as openings in the form of holes or perforations in the substantially air impermeable tipping material, plug wrap and rod wrapping material which can permit the passage of air therethrough into the cigarette. As used herein, the term "air dilution" is the ratio of the volume of air drawn through air dilution openings or vents to the total volume of air and smoke drawn through the smoking article and exiting the extreme mouthend portion of the smoking article. Openings 10 form air dilution means which are capable of providing relatively high amounts of air dilution to the smoking article upon use. Openings 10 are positioned at that region of the filter cigarette towards the rod end region of the filter element or in the rod in the region adjacent to the filter element. Openings 14 form air dilution means which are capable of providing relatively low amounts of air dilution to the smoking article upon use. Openings 14 are positioned at that region of the filter cigarette adjacent the mouthend thereof relative to openings 10. By the terms "relatively high" and "relatively low" in referring to the amounts of air dilution of the smoking article is meant that the air dilution provided by openings 14 toward the mouthend of the filter cigarette are capable of providing less air dilution to the smoking article relative to openings 10 which are positioned at a greater longitudinal distance from the mouthend of the filter cigarette. Relative amounts of air dilution can be provided by varying the number of openings, the size of the openings, etc. In particular, relatively greater amounts of air dilution can be provided by cutting relatively long and/or wide slits or slots into the filter cigarette, by punching relatively large numbers of holes and/or punching relatively large size holes into the cigarette, or other such means. For example, two sets of openings on a filter element of a cigarette which are spaced 15 mm apart as measured longitudinally along the cigarette can generally provide a smoking article which, when one set of the openings is covered by the sleeve and one set of the openings is exposed, exhibits similar pressure drops; when the openings nearer the rod end of the filter cigarette are exposed to permit air dilution a difference of about 40 percent as compared to the openings adjacent the mouthend of the cigarette is obtained. It is particularly desirable that the openings of each air dilution region extend a minimal distance longitudinally along the cigarette. Typically, each air dilution region extends circumferentially around the cigarette or a portion of the cigarette. The combination of all the air dilution regions extend longitudinally along the length of the cigarette.

Figure 2:
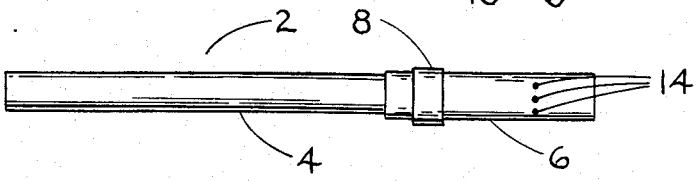

In FIGS. 1 and 2 an illustrated embodiment of the invention includes a filter cigarette having sleeve 8 which is movable longitudinally along the axis of the smoking article. Sleeve 8 can be positioned over the openings adjacent the mouthend of the smoking article providing a barrier to air dilution through those openings and thus exposing openings 10 in the rod end region of the filter element (as shown in FIG. 1) in order to provide a smoking article having relatively high air dilution capabilities. Sleeve 8 can be positioned towards the rod end region of the cigarette and positioned over the openings positioned in the rod end region of the filter element providing a barrier to air dilution through those openings and thus exposing openings 14 adjacent the mouthend of the filter element (as shown FIG. 2) in order to provide a smoking article having relatively high air dilution capabilities. Generally, the positioning of the openings depends upon the length of the filter.

Normally, openings are positioned at least about 11 mm from the extreme mouthend point of the cigarette, and up to about 35 mm from the extreme mouthend point of the cigarette. Sleeve 8 of the embodiment shown in FIGS. 1 and 2 extends along the filter cigarette in an amount which can vary. Typically, the longitudinally extending length of the sleeve depends upon the length of the filter and ranges from about 5 mm to about 20 mm.

Figure 3:
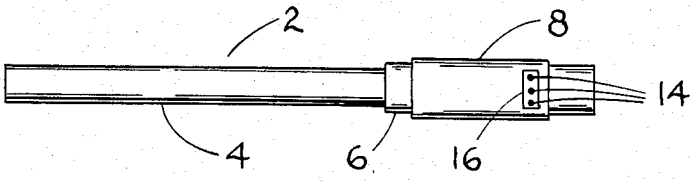
FIGS. 3 and 4 are diagrammatic illustrations of an embodiment of the smoking article in the form of a filter cigarette and sleeve circumscribing the cigarette, wherein the sleeve is rotatable circumferentially about the longitudinal axis of the smoking article to provide low air dilution setting and high air dilution setting, respectively.
Figure 4:
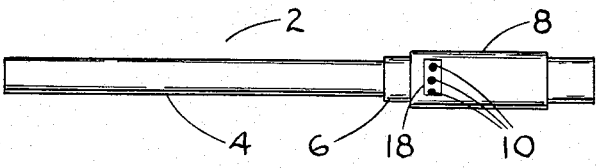

In FIGS. 3 and 4 an illustrated embodiment of this invention includes a filter cigarette having sleeve 8 which is rotatable circumferentially about the longitudinal axis of the smoking article. Sleeve 8 has at least two air permeable regions therein, each of which regions extends circumferentially about a portion of the sleeve, each of which regions is spaced apart longitudinally along the sleeve from one another, and each of which regions is not in direct longitudinal alignment (i.e., is staggered) along the sleeve. Air dilution openings are positioned longitudinally along the filter cigarette in the region which underlies the sleeve. Preferably, the number of air permeable regions in the sleeve is equal to the number of air dilution means. Preferably, the air dilution openings are in direct longitudinal alignment along the cigarette (i.e., parallel to the longitudinal axis of the cigarette). Sleeve 8 can be rotatably positioned in the low air dilution setting in order that opening 16 therein located towards the mouthend portion of the smoking article is aligned with and exposes air dilution openings 14 of the cigarette located adjacent the mouthend of the filter element (as shown in FIG. 3). The substantially air impermeable portion of the sleeve overlies the openings in the cigarettes toward the rod end thereof and provides a barrier to air dilution through the air dilution openings toward the rod end of the cigarette. Sleeve 8 can be further rotatably positioned to provide the high air dilution settings whereby opening 18 therein located towards the rod end portion of the smoking article is aligned with and exposes air dilution openings 10 of the cigarette located toward the rod end region of the cigarette (as shown in FIG. 4). The sleeve is positioned over the openings adjacent the mouthend of the cigarette and thus provides a barrier to air dilution through those openings. If more than two air dilution means are employed, the various air dilution means are positioned along the longitudinal length of a portion of the cigarette, and the various air dilution means exhibit progressively less air dilution capabilities as positioned toward the mouthend of the cigarette.

In an embodiment similar to that embodiment illustrated in FIGS. 3 and 4 (but not shown) a filter cigarette has a sleeve which is rotatable circumferentially about the longitudinal axis of the smoking article. The sleeve has at least two air permeable regions therein, each of which regions extend circumferentially about a portion of the sleeve, each of which regions is spaced apart longitudinally along the sleeve from one another, and each of which regions is in direct longitudinal alignment along the sleeve. Air dilution openings are positioned longitudinally along the filter cigarette in the region which underlies the sleeve. Preferably, the number of air permeable regions in the sleeve is equal to the number of air dilution means. Preferably, the air dilution openings are not in direct longitudinal alignment along the cigarette. The sleeve can be rotatably positioned in the low air dilution setting in order that the opening therein located towards the mouthend portion of the smoking article is aligned with and exposes air dilution openings of the cigarette located adjacent the mouthend of the filter element. The substantially air impermeable portion of the sleeve overlies the openings in the cigarettes toward the rod end thereof and provides a barrier to air dilution through the air dilution openings toward the rod end of the cigarette. The sleeve can be further rotatably positioned to provide the high air dilution settings whereby the opening therein located towards the rod end portion of the smoking article is aligned with and exposes air dilution openings of the cigarette located toward the rod end region of the cigarette. The sleeve is positioned over the openings adjacent the mouthend of the cigarette and thus provides a barrier to air dilution through those openings. If more than two air dilution means are employed, the various air dilution means are positioned along the longitudinal length of a portion of the cigarette, and each of the various air dilution means exhibit progressively less air dilution capabilities as positioned toward the mouthend of the cigarette.

Figure 5:
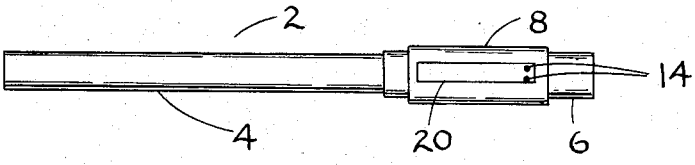
FIGS. 5 and 6 are diagrammatic illustrations of an embodiment of the smoking article in form of a filter cigarette and sleeve circumscribing the cigarette, wherein the sleeve is rotatable circumferentially about the longitudinal axis of the smoking article to provide low air dilution setting and high air dilution setting, respectively.
Figure 6:
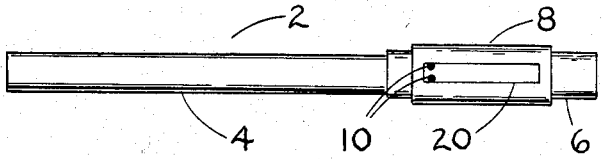

In FIGS. 5 and 6 an illustrated embodiment of this invention includes a filter cigarette having sleeve 8 which is rotatable circumferentially about the longitudinal axis of the smoking article. Sleeve 8 has an air permeable region therein which extends longitudinally along a portion of the sleeve essentially directly along the sleeve (i.e., parallel to the longitudinal axis of the sleeve). The width of the air permeable region is sufficiently great so as to provide for exposure of each of the various air dilution regions which underlie the sleeve. Air dilution openings are positioned longitudinally along the filter cigarette in the region which underlies the sleeve. The air dilution openings are not in direct longitudinal alignment (i.e., are staggered) along the cigarette. Sleeve 8 can be rotatably positioned in the low air dilution setting in order that a portion of opening 20 therein, which portion is located towards the mouthend portion of the smoking article, exposes air dilution openings 14 of the cigarette located adjacent the mouthend of the filter element (as shown in FIG. 5). The substantially air impermeable portion of the sleeve overlies the openings in the cigarette towards the rod end thereof and provides a barrier to air dilution through the air dilution openings in the cigarette toward the rod end thereof due to the narrowness of the width of opening 20 in sleeve 8 and the non direct (i.e., staggered) longitudinal alignment of the air dilution openings in the cigarette. Sleeve 8 can be further rotatably positioned to provide the high air dilution setting whereby a portion of opening 20 therein, which portion is located towards the rod end portion of the smoking article, exposes air dilution openings 10 of the cigarette located toward the rod end region of the cigarette (as shown in FIG. 6). The sleeve is positioned over the openings adjacent the mouthend of the cigarette and thus provides a barrier to air dilution through those openings. If more than two air dilution means are employed, the various air dilution means are positioned along the longitudinal length of a portion of the cigarette, and each of the various air dilution means exhibit progressively less air dilution capabilities as positioned toward the mouthend of the cigarette.

Figure 7:
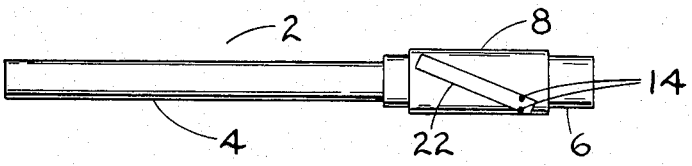
FIGS. 7 and 8 are diagrammatic illustrations of an embodiment of the smoking article in form of a filter cigarette and sleeve circumscribing the cigarette, wherein the sleeve is rotatable circumferentially about the longitudinal axis of the smoking article to provide low air dilution setting and high air dilution setting, respectively.
Figure 8:
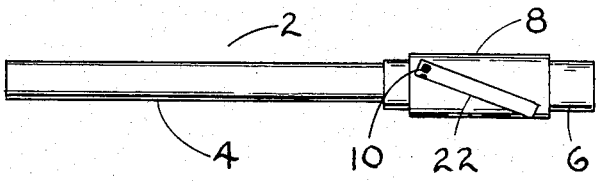

In FIGS. 7 and 8 an illustrated embodiment of this invention includes a filter cigarette having sleeve 8 which is rotatable circumferentially about the longitudinal axis of the smoking article. Sleeve 8 has an air permeable region therein which extends in a longitudinal and circumferential direction (i.e., diagonally) along a portion of sleeve. The width of the air permeable region is sufficiently great so as to provide for exposure of each of the various desired air dilution regions which underlie the sleeve. Air dilution openings are positioned longitudinally along the filter cigarette in the region which underlies the sleeve. Preferably, the air dilution openings are in direct longitudinal alignment along the cigarette (i.e., parallel to the longitudinal axis of the cigarette). Sleeve 8 can be rotatably positioned in the low air dilution setting in order that a portion of opening 22 therein, which portion is located towards the mouthend portion of the smoking article, exposes air dilution openings 14 of the cigarette located adjacent the mouthend of the filter element (as shown in FIG. 7). The substantially air impermeable portion of the sleeve overlies the openings in the cigarette towards the rod end thereof and provides a barrier to air dilution through the air dilution openings in the cigarette toward the rod end thereof due to the narrowness of the width of opening 22 in sleeve 8 and the non direct (i.e., diagonal) longitudinal alignment of opening 22 in the sleeve relative to the air dilution openings in the cigarette. Sleeve 8 can be further rotatably positioned to provide the high air dilution setting whereby a portion of opening 22 therein, which portion is located towards the rod end portion of the smoking article, exposes air dilution openings 10 of the cigarette located toward the rod end region of the cigarette (as shown in FIG. 8). The sleeve is positioned over the openings adjacent the mouthend of the cigarette and thus provides a barrier to air dilution through those openings. If more than two air dilution means are employed, the various air dilution means are positioned along the longitudinal length of a portion of the cigarette, and each of the various air dilution means exhibit progressively less air dilution capabilities as positioned toward the mouthend of the cigarette.

As used herein, the term "pressure drop" in referring to smoking articles is meant that difference between atmospheric pressure and that pressure at the exit (or extreme mouthend) point of the smoking article, as measured at a given flow rate through the smoking article. Typical pressure drop values for low air dilution filter cigarettes ranges from about 95 mm to about 130 mm of water at 17.5 ml./sec. of air flow rate. In addition, by the term "substantially reducing the pressure drop decrease" is meant a substantial reduction in the pressure drop decrease which is exhibited with increased air dilution of the smoking article. In particular, the reduction in pressure drop decrease can be such that the pressure drop of the smoking article at high air dilution nearly approximates that pressure drop at low air dilution, or that the pressure drop of the smoking article at high air dilution exceeds that pressure drop at low air dilution.

It is understood that the particular embodiments described above are only illustrative of the principles of this invention, and that various modifications can be made by those skilled in the art without departing from the scope and spirit of the invention.

The following examples are provided in order to further illustrate the invention but are not to be construed as limiting the scope thereof.

EXAMPLE 1

Commercially available filter cigarettes having tubular rod shapes and lengths of about 84 mm and diameters of about 8 mm were provided. The length of the tobacco rods were about 57 mm and the length of the cellulose acetate tow filter element was about 27 mm for each cigarette. Openings in the form of perforations were made using a sewing needle in the tipping paper, plug wrap and cigarette wrapper as necessary to provide air dilution regions. Two regions of perforations were made so as to each provide the desired air dilution. The regions were each positioned in an essentially circumferentially extending manner about a portion of the cigarette. A tubular shaped sleeve was provided from air impermeable glassine paper and fit snugly over the cigarette so as to extend 15 mm along the length of the cigarette. The sleeve was movable longitudinally along the length of the cigarette and was positioned so as to overlie one region of perforations thereby providing a barrier to air dilution therethrough, while exposing the other region of perforations. Measurements of pressure drop and wet total particulate matter (WTPM) were measured for each smoking article with each air dilution region exposed for air dilution and the corresponding air dilution region covered by the sleeve. Data are presented in Table I.

TABLE I

| Smoking Article Sample | Perforations Exposed (mm from extreme mouthend of smoking article) | Pres. Drop[1] | Air Dilution[2] | WIPM[3] (mg/smoking article) |
|---|---|---|---|---|
| 1 | 13 | 114 | 39 | 9.8 |
| 1 | 28 | 116 | 73 | 4.2 |
| 2 | 13 | 132 | 28 | 11.7 |
| 2 | 28 | 118 | 80 | 2.8 |
| C-1* | 13 | 105 | 51 | 8.6 |
| C-1* | 28 | 138 | 37 | 12.7 |
| C-2* | 13 | 100 | 48 | 8.0 |
| C-2* | 28 | 126 | 48 | 9.4 |

*not an example of the invention and tested for comparison purposes.
[1]Pressure drop is reported in mm $H_2O$ at 17.5 ml/sec air flow rate.
[2]Air dilution is the ratio of the volume of air drawn through the air dilution openings to the total volume of air and smoke drawn through the smoking article and exiting the extreme mouthend point of the smoking article, and is expressed in percent.
[3]Wet total particulate matter was measured using standard techniques and is indicative of the delivery provided by the sample.

The data in Table I indicates that the samples of this invention (i.e., Sample Nos. 1 and 2) do not exhibit a substantial decrease in pressure drop upon increased air dilution thereof. The samples of this invention do not exhibit an undesirable decrease in pressure drop when positioned for low delivery. Surprisingly, the pressure drop exhibited by Sample No. 1 is greater at high air dilution than at low air dilution. Correspondingly, comparative Sample No. C-1 does exhibit a substantial decrease in pressure drop upon increased air dilution thereof. Sample Nos. C-1 and C-2 exhibit an undesirably high decrease in pressure drop when positioned for a relatively small decrease in delivery.

What is claimed is:

1. A smoking article capable of exhibiting a substantial reduction of pressure drop decrease with increased air dilution thereof and having the form of a filter cigarette having in combination a rod of smokable material, an axially aligned filter plug at one end of the rod, a substantially air impermeable tipping material circumscribing and being fixedly attached to each of the filter plug and a portion of the rod in the region adjacent the filter plug; said smoking article further comprising a substantially air impermeable sleeve circumscribing the cigarette and longitudinally extending along a portion of the length of the cigarette; the cigarette having at least two air dilution means positioned in the tipping material to permit the passage of air therethrough and into the cigarette, the means for greatest air dilution being positioned a greater distance from the extreme mouthend of the cigarette relative to the means for least air dilution; the sleeve being movable relative to the cigarette whereby one of the air dilution means is exposed to permit air dilution of the smoking article and the sleeve overlies the remaining air dilution means thereby providing a substantial barrier to air dilution therethrough.

2. The smoking article of claim 1 wherein said means for greatest air dilution extends a minimal distance longitudinally along the cigarette.

3. The smoking article of claim 1 wherein said means for least air dilution extends a minimal distance longitudinally along the cigarette.

4. The smoking article of claim 1 wherein the sleeve is movable longitudinally along the axis of the smoking article in order to overlie either the means for greatest air dilution or the means for least air dilution.

5. A smoking article capable of exhibiting a substantial reduction of pressure drop decrease with increased air dilution thereof and having the form of a filter cigarette having in combination a rod of smokable material, an axially aligned filter plug at one end of the rod, a substantially air irpermeable tipping material circumscribing and being fixedly attached to each of the filter plug and a portion of the rod in the region adjacent the filter plug;

said smoking article further comprising a substantially air impermeable sleeve circumscribing the cigarette and longitudinally extending along a portion of the length of the cigarette;

the cigarette having at least two air dilution means positioned therein, wherein the means for greatest air dilution is positioned a greater distance from the extreme mouthend of the cigarette relative to the means for least air dilution;

the sleeve being movable relative to the cigarette whereby one of the air dilution means is exposed to permit air dilution of the smoking article and the sleeve overlies the remaining air dilution means thereby providing a substantial barrier to air dilution therethrough;

wherein the sleeve is rotatable circumferentially about the longitudinal axis of the smoking article and comprises at least two air permeable regions therein, which regions extend circumferentially about a portion of the sleeve; said air permeable regions being spaced apart longitudinally along the sleeve from one another and being positioned not in direct longitudinal alignment along the sleeve; and said air dilution means being positioned in direct longitudinal alignment along the cigarette in the regions which underlie the sleeve, the number of air permeable regions being equal to the number of air dilution means.

6. The smoking article of claim 5 wherein the sleeve comprises two air permeable regions in the form of openings therein.

7. The smoking article of claim 5 wherein said air dilution means are openings in the tipping material which permit the passage of air therethrough into the cigarette.

8. A smoking article capable of exhibiting a substantial reduction of pressure drop decrease with increased air dilution thereof and having the form of a filter cigarette having in combination a rod of smokable material, an axially aligned filter plug at one end of the rod, a substantially air impermeable tipping material circumscribing and being fixedly attached to each of the filter plug and a portion of the rod in the region adjacent the filter plug;

said smoking article further comprising a substantially air impermeable sleeve circumscribing the cigarette and longitudinally extending along a portion of the length of the cigarette;

the cigarette having at least two air dilution means positioned therein, wherein the means for greatest air dilution is positioned a greater distance from the extreme mouthend of the cigarette relative to the means for least air dilution;

the sleeve being movable relative to the cigarette whereby one of the air dilution means is exposed to permit air dilution of the smoking article and the sleeve overlies the remaining air dilution means thereby providing a substantial barrier to air dilution therethrough;

wherein the sleeve is rotatable circumferentially about the longitudinal axis of the smoking article and comprises at least two air permeable regions therein, which regions extend circumferentially about a portion of the sleeve; said air permeable regions being spaced apart longitudinally along the sleeve from one another and being positioned in direct longitudinal alignment along the sleeve; and said air dilution means being positioned not in direct longitudinal alignment along the cigarette in the regions which underlie the sleeve, the number of air permeable regions being equal to the number of air dilution means.

9. The smoking article of claim 8 wherein the sleeve comprises two air permeable regions in the form of openings therein.

10. The smoking article of claim 8 wherein the sleeve comprises more than two air permeable regions in the form of openings therein; and the air dilution means are positioned along the longitudinal length of the cigarette, and each air dilution means positioned progressively away from the mouthend of the cigarette exhibits progressively more air dilution capabilities than each air dilution means positioned progressively toward the mouthend of the cigarette.

11. The smoking article of claim 8 wherein said air dilution means are openings in the tipping material which permit the passage of air therethrough into the cigarette.

12. A smoking article capable of exhibiting a substantial reduction of pressure drop decrease with increased air dilution thereof and having the form of a filter cigarette having in combination a rod of smokable material, an axially aligned filter plug at one end of the rod, a substantially air impermeable tipping material circumscribing and being fixedly attached to each of the filter plug and a portion of the rod in the region adjacent the filter plug;

said smoking article further comprising a substantially air impermeable sleeve circumscribing the cigarette and longitudinally extending along a portion of the length of the cigarette;

the cigarette having at least two air dilution means positioned therein, wherein the means for greatest air dilution is positioned a greater distance from the extreme mouthend of the cigarette relative to the means for least air dilution;

the sleeve being movable relative to the cigarette whereby one of the air dilution means is exposed to permit air dilution of the smoking article and the sleeve overlies the remaining air dilution means thereby providing a substantial barrier to air dilution therethrough;

wherein the sleeve is rotatable circumferentially about the longitudinal axis of the smoking article and comprises an air permeable region therein which extends longitudinally along a portion of the sleeve essentially directly along the sleeve;

said air dilution means being positioned not in direct longitudinal alignment along the cigarette in the region which underlies the sleeve.

13. The smoking article of claim 12 wherein the cigarette comprises two means for air dilution.

14. The smoking article of claim 12 wherein the cigarette comprises more than two air dilution means and the air dilution means are positioned along the longitudinal length of the cigarettes and each air dilution means positioned progressively away from the mouthend of the cigarette exhibits progressively more air dilution capabilities than each air dilution means positioned progressively toward the mouthend of the cigarette.

15. The smoking article of claim 12 wherein said air dilution means are openings in the tipping material which permit the passage of air therethrough into the cigarette.

16. A smoking article capable of exhibiting a substantial reduction of pressure drop decrease with increased air dilution thereof and having the form of a filter cigarette having in combination a rod of smokable material, an axially aligned filter plug at one end of the rod, a substantially air impermeable tipping material circumscribing and being fixedly attached to each of the filter plug and a portion of the rod in the region adjacent the filter plug;

said smoking article further comprising a substantially air impermeable sleeve circumscribing the cigarette and longitudinally extending along a portion of the length of the cigarette;

the cigarette having at least two air dilution neans positioned therein, wherein the means for greatest air dilution is positioned a greater distance from the extreme mouthend of the cigarette relative to the means for least air dilution;

the sleeve being movable relative to the cigarette whereby one of the air dilution means is exposed to permit air dilution of the smoking article and the sleeve overlies the remaining air dilution means thereby providing a substantial barrier to air dilution therethrough;

wherein the sleeve is rotatable circumferentially about the longitudinal axis of the smoking article and comprises an air permeable region therein which extend diagonally along a portion of the sleeve;

said air dilution means being positioned in direct longitudinal along the cigarette in the region which underlies the sleeve.

17. The smoking article of claim 16 wherein the cigarette comprises two means for air dilution.

18. The smoking article of claim 16 wherein the cigarette comprises more than two air dilution means and the air dilution means are positioned along the longitudinal length of the cigarettes and each air dilution means positioned progressively away from the mouthend of the cigarette exhibits progressively more air dilution capabilities than each air dilution means positioned progressively toward the mouthend of the cigarette.

19. The smoking article of claim 16 wherein said air dilution means are openings in the tipping material which permit the passage of air therethrough into the cigarette.

20. The smoking article of claim 5 wherein the sleeve comprises more than two air permeable regions in the form of openings therein; and the air dilution means are positioned along the longitudinal length of the cigarette, and each air dilution means positioned progressively away from the mouthend of the cigarette exhibits progressively more air dilution capabilities than each air dilution means positioned progressively toward the mouthend of the cigarette.

* * * * *